US011134780B2

(12) United States Patent
Maier et al.

(10) Patent No.: US 11,134,780 B2
(45) **Date of Patent: *Oct. 5, 2021**

(54) CHAIR, PARTICULARLY CONFERENCE OR OFFICE CHAIR, AND METHOD FOR MANUFACTURING A CHAIR

(71) Applicant: Sedus Stoll AG, Waldshut (DE)

(72) Inventors: Klaus Maier, Dachsberg (DE); Judith Daur, Waldshut-Tiengen (DE); Carlo Shayeb, Laufenburg (DE); Falk Bluemler, Dachsberg (DE); Philipp Mueller, Waldshut-Tiengen (DE)

(73) Assignee: SEDUS STOLL AG, Waldshut (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/938,507

(22) Filed: Jul. 24, 2020

(65) Prior Publication Data

US 2020/0352335 A1 Nov. 12, 2020

Related U.S. Application Data

(63) Continuation of application No. 16/132,739, filed on Sep. 17, 2018, now Pat. No. 10,820,703.

(51) Int. Cl.
*A47C 7/44* (2006.01)
*A47C 1/024* (2006.01)
(Continued)

(52) U.S. Cl.
CPC ..... *A47C 1/03261* (2013.01); *A47C 3/18* (2013.01); *A47C 7/44* (2013.01)

(58) Field of Classification Search
CPC ... A47C 1/03255; A47C 7/46; A47C 1/03277; A47C 1/03294; A47C 7/14
See application file for complete search history.

(56) References Cited

U.S. PATENT DOCUMENTS 5,486,035 A * 1/1996 Koepke ..... A47C 1/03255 297/300.1
5,765,804 A * 6/1998 Stumpf ..... A47C 1/03238 248/631

(Continued)

FOREIGN PATENT DOCUMENTS

DE 297 04 906 U1 5/1997
DE 10 2011 120753 A1 6/2013

(Continued)

*Primary Examiner* — Shin H Kim
(74) *Attorney, Agent, or Firm* — Maginot, Moore & Beck LLP

(57) ABSTRACT

A chair, such as a conference or office chair, includes a seat support; a backrest support; a storage member formed as a force storage element; and a transmission coupling the seat support with the backrest support which allows a pivoting of the backrest support and the seat support between an upright position and a backwardly pivoted position according to a predetermined sequence of movements. The force storage element is coupled with the seat support and the backrest support such that the predetermined sequence of movements is facilitated and the storage member provides a force restoring in the upright position and wherein the flexibly elastic storage member forms in conjunction at least with a first articulated rotation point of the transmission a kinematic chain.

20 Claims, 6 Drawing Sheets

(51) Int. Cl.
*A47C 1/032* (2006.01)
*A47C 3/18* (2006.01)

(56) References Cited

U.S. PATENT DOCUMENTS 5,931,531 A * 8/1999 Assmann ..... A47C 1/03255 297/316
6,869,142 B2 * 3/2005 Heidmann ..... A47C 7/14 297/300.1
6,880,886 B2 * 4/2005 Bodnar ..... A47C 7/14 297/285
6,932,430 B2 * 8/2005 Bedford ..... A47C 1/023 297/300.2
6,957,863 B2 * 10/2005 Heidmann ..... A47C 1/03255 297/300.1
7,165,811 B2 * 1/2007 Bodnar ..... A47C 1/03274 297/300.2
7,226,130 B2 * 6/2007 Tubergen ..... A47C 7/14 297/452.52
7,360,835 B2 * 4/2008 Tubergen ..... A47C 7/14 297/284.11
8,888,182 B2 * 11/2014 Ivicevic ..... A47C 1/023 297/294
10,820,703 B2 * 11/2020 Maier ..... A47C 1/03277
2002/0149247 A1 10/2002 Diffrient
2004/0051358 A1 * 3/2004 Bodnar ..... A47C 31/04 297/300.1
2004/0051362 A1 * 3/2004 Heidmann ..... A47C 3/0252 297/342
2006/0097558 A1 * 5/2006 Aubert ..... A47C 1/03238 297/344.26
2006/0202534 A1 * 9/2006 Heidmann ..... A47C 7/44 297/354.1
2007/0222265 A1 * 9/2007 Machael ..... A47C 1/03266 297/300.2
2010/0164263 A1 * 7/2010 Malenotti ..... A47C 1/03266 297/300.1
2010/0244515 A1 * 9/2010 Ivicevic ..... A47C 1/03272 297/239
2012/0181831 A1 * 7/2012 Meier ..... A47C 1/03266 297/300.2
2014/0077540 A1 * 3/2014 Peterson ..... A47C 7/386 297/220
2014/0110983 A1 * 4/2014 Sander ..... A47C 7/004 297/284.1
2015/0091353 A1 * 4/2015 Horn ..... A47C 3/00 297/354.11
2016/0143443 A1 * 5/2016 Roslund, Jr. ..... A47C 7/004 297/299

FOREIGN PATENT DOCUMENTS

DE 20 2012 012606 U1 6/2013
DE 10 2016 217503 A1 3/2018
EP 1 230 876 A1 8/2002
JP 2013 132403 A 7/2013
WO 2008000295 A1 3/2008

* cited by examiner

CHAIR, PARTICULARLY CONFERENCE OR OFFICE CHAIR, AND METHOD FOR MANUFACTURING A CHAIR

REFERENCE TO RELATED APPLICATION

This application is a continuation of and claims priority to co-pending application Ser. No. 16/132,739, filed on Sep. 17, 2018, the entire disclosure of which is incorporated herein by reference.

FIELD OF THE INVENTION

The present invention relates to a chair, particularly a conference or office chair, as well as a method for manufacturing such a chair.

BACKGROUND

Although the present invention as well as the problem underlying it will be described in greater detail below with reference to office swivel chairs, the present invention is not limited thereto, but is applicable to various chairs, in particular conference or office chairs.

There are office swivel chairs having various designs of a pivoting and synchronizing mechanism, respectively. A synchronizing mechanism specifies an exact sequence of movements and has an integrated spring, which provides a bias for the sequence of movements.

An office swivel chair having a pivoting mechanism is described for example in document US 2002/0149247 A1. The base and link of such a pivoting mechanism are designed relatively massive. Therefore, the pivoting mechanism on the whole requires a relatively large installation space so that the overall construction of such an office swivel chair below the seat support appears to be very massive, which is disadvantageous particularly also in terms of design aspects.

From DE 10 2016 217503 a chair having a more slender appearance is already known, the backrest support and seat support of which have an articulated joint and in which the pivoting mechanism is realized by a force-storing element, which is disposed between the backrest support and the seat support, in form of an armrest support provided with a spring. It is therefore compulsory to provide the chair in question with armrests, and furthermore, the bias to be established in the unloaded position of the chair represents by exactly these armrests a configuration, which is not always easy to handle.

SUMMARY OF THE INVENTION

Against this background, the object of the present invention is to provide an improved chair, in particular a conference or office chair. The chair in question should not only be of high quality, but also be easy and inexpensive to produce. By virtue of these properties, also alternative uses, for example in the private sector, may be devised as appropriate.

Accordingly, there is provided:

A chair, particularly a conference or office chair, including a seat base, at which a supporting means of the chair is disposed, wherein the supporting means has at least one seat support and at least one backrest support; and wherein the supporting means is provided with a transmission coupling the seat support to the backrest support which allows for pivoting the backrest support and the seat support between an upright position and a backwardly pivoted position using a predetermined sequence of movements, wherein a flexibly elastic storage member is provided and installed at the transmission which, when the supporting means is charged, provides a force restoring to the upright position, and wherein the flexibly elastic storage member in conjunction with at least one first articulated rotation point of the transmission forms a kinematic chain.

A method for manufacturing a chair, comprising the steps of: providing a supporting means having a seat support, a backrest support and a transmission coupling the seat support to the backrest support which allows for pivoting the backrest support and the seat support between an upright position and a backwardly pivoted position using a predetermined sequence of movements; coupling a storage member provided and installed at the transmission to the supporting means so that the predetermined sequence of movement is facilitated and a force restoring to the upright position is provided by the storage member, wherein a kinematic chain is formed by the flexibly elastic storage member with at least one first articulated rotation point of the transmission.

A swivel chair, particularly a conference or office swivel chair, including a swivel chair base; including a backrest support; including a seat support having a seat receiving portion for receiving a seating surface, a base receiving portion for receiving of the swivel chair base, and a force storage formed integrally with the seat receiving portion and the base receiving portion; and including a transmission coupling the seat support to the backrest support which allows for pivoting the backrest support and the seat receiving portion between an upright position and a backwardly pivoted position using a predetermined sequence of movements, wherein the transmission has a first rotation point which couples the backrest support with the base receiving portion rotatably, and a second rotation point which couples the backrest support with the seat receiving portion rotatably, wherein the force storage is configured to facilitate the predetermined sequence of movements, and the force storage provides for this a force restoring to the upright position.

The idea, on which the present invention is based, is to employ a flexibly elastic storage member, which is disposed in the region of the transmission by means of which the chair in question, for example an office of conference chair, can be pivoted in a synchronous or synchronous similar manner, as a force storage for a predetermined sequence of movements when pivoting the backrest support and the seat support coupled thereto by the transmission. To this end, a flexibly elastic storage member is coupled to the seat support and the backrest support or a force storage is integrated directly in the seat support or is formed as an integral portion of the seat support. When pivoting, the storage member that is the force storage is tensioned and, in this way, transmits a force restoring the backrest support and the seat support to the upright position.

In this way, according to one aspect, the storage member can replace a biasing spring in the region of the transmission. Thus, the arrangement of the chair may advantageously have a substantially slimmer design, which appears esthetically and is therefore advantageous in terms of design aspects. To this end the flexibly elastic storage member in conjunction with at least one first articulated rotation point of the transmission forms a kinematic chain so that the storage member according to the invention is advantageously integrated into transmitting movements and torques when loading and unloading the chair according to the invention. The storage member of the transmission, which is provided at the supporting means, therefore forms a planar gear.

In accordance with a further aspect, a seat support and a transmission can do completely without any additional force storage elements. To this end the seat support itself exhibits, in the region of the integral force storage, the flexibility required by the sequence of movements and suitable for the desired restoring force.

The seat base is, in the case of a swivel chair, in particular, a conference or office swivel chair, embodied as swivel chair base, for example, including a rotating foot. The base receiving portion is correspondingly embodied for receiving, that is for a secured support, of the rotating foot.

The seating surface is embodied with at least one structural element provided for receiving seating forces and for introducing the seating forces into the seat support. A seating padding can be arranged on the structural element.

The first rotation point and/or the second rotation point may exhibit a rotation axis. For example, the rotation axis of the first rotation point can exhibit a pin or bolt supported in the base receiving portion and/or the rotation axis of the second rotation point can exhibit a pin or bolt supported in the seat receiving portion, which pin or bolt is coupled to the backrest support rotatably or is rotatably incorporated therein.

Moreover, an integration, according to the invention, of a force storage possibly including a storage member allows a novel overall design of the chair. In particular, also other parts moving in the predetermined sequence of movements may exhibit a certain degree of flexibility. Consequently, a new approach is taken with regard to the predetermined sequence of movements when pivoting the chair. Instead of specifying a sequence of movements of the transmission of a synchronizing mechanism rather rigidly and precisely, a predetermined flexibility of one or more parts is included in the predetermined sequence of movements.

In one embodiment the seat support of the supporting means can for example be integrated as part of the storage member and can replace articulated rotation points of the kinematic chain by the corresponding flexibility. A flexible design of the parts in turn allows advantageously a specially slender design as well as the use of materials which can easily be formed.

The transmission is in particular provided as replacement for a conventional synchronizing mechanism and functions preferably synchronous-similar such that during pivoting a predetermined sequence of operations as with a synchronizing mechanism can be described. Accordingly, the backrest support and the seat support respectively pivot in a predetermined manner absolutely and relatively with respect to each other. The seat support and the backrest support pivot to different degrees. In particular, a predetermined transmission ratio can be provided for this. Furthermore, preferably the seat support may be lifted slightly. Advantageously, the functionality of a synchronizing mechanism with known advantages, such as avoiding a shirt pulling effect or similar, is maintained from the user point of view.

It is special, compared to a conventional synchronizing mechanism, in particular that also the storage member embodied as a force storage element experiences an elastic deformation and consequently describes also a certain sequence of movements due to the continuously increasing bias during the backwards pivoting.

Embodiments and improvements are apparent from the further dependent claims as well as from the description with reference to the figures of the drawing.

To this end the transmission can, besides merely the first articulated rotation point, also exhibit the first and a second articulated rotation point which are part of the kinematic chain in preferred embodiments of the chair according to the invention. In this manner, the backrest support can be embodied pivotable with respect to two different arms or legs of the storage member, wherein one of these legs can for example form the seat support of the seating means.

In another preferred embodiment of the chair the flexibly elastic storage member can map at least two rotation points of the kinematic chain or the storage member can comprise at least two virtual rotation points, respectively. To this end the storage member is for example embodied flexibly in such a manner that charging of the chair by receiving a person who is in the process to sit down, is transformed in elastic material deformations of the storage member which mechanically can be interpreted as rotations around rotation points which are only present virtually. These virtual rotation points are arranged along the structure of the storage member, their stringing together with the real articulated rotation points of the transmission forms a polygon chain and together with the articulated rotation point of the transmission forms the kinematic chain. In particular in the region of the virtual rotation points, locally provided an increased flexibility of the storage member is provided locally, for example by means of an adapted local material selection and/or local structural design. In the region of the virtual rotation points there may be provided in particular a material tapering or shifting for a local reduction of the geometrical moment of inertia. In this manner bends will here locally cause more elastic deformation, such that the connected structure here virtually rotates.

In accordance with an embodiment the transmission is coupled with a seat base. Thus, the transmission causes a force deviation between backrest support, seat support and seat base and for this purpose has a first and a second rotation point, of which at least the at least one articulated rotation point of the transmission is coupled with the seat basis and is fixedly arranged relative to it. Furthermore, the transmission may exhibit a first virtual and a second virtual rotation point which are comprised by the storage member, wherein the at least one articulated rotation point is coupled with a second articulated rotation point arranged at the storage member via a first link and the two virtual rotation points are coupled to each other via a second link, wherein the first link is connected with the backrest support or is integrally formed with the backrest support. Hereby, a rectangular and in particular parallelogram-like construction of the transmission with an articulated rotation point respectively fixed at the seat basis and the seat support can be presented. In particular, the transmission does not need a slip joint or carriage guide and is consequently free of a carriage. In this manner the sequence of movements of a synchronizing mechanism is realized in a very slender construction.

Furthermore, in a further advantageous embodiment which has the same arrangement of the transmission, the backrest support may be supported at the at least one articulated rotation point rotatably with regard to the seat base, and the storage member or respectively the seat support connected thereto can at a free end either be provided with a second articulated rotation point at which it is connected rotatably with the backrest support, or can be flexibly connected with the backrest support, in particular through a bar. In the latter case, the joint of the seat support at the storage member forms a third virtual rotation point and the transmission then only exhibits only one "real" articulated rotation point, namely the at least one which has already been mentioned before.

In a preferred embodiment of the chair, the flexibly elastic storage member may be connected with the seat support, may be formed thereon or arranged integrally or in one piece with it. In particular, the seat support of the chair can form a part of the storage member and can form by means of its elastic construction a part of the force storage which in turn builds up and provides the restoring force. In a further embodiment the storage member may be formed as part of the seat support.

To this end the storage member of the transmission can be formed with an elastic deformable plastic material, in particular a fiber-reinforced plastic, which exhibits at the storage member in a suitable manner the flexibly elastic property.

In a preferred embodiment the storage member with the seat support may exhibit a bent shape which in the idle position of the chair forms approximately an acute angle between 1° and 40°, preferably between 10° and 30°, more preferably 25°.

At the supporting means at at least one chair side, at least one armrest support, in particular at each chair side respectively one armrest support, which can be connected with the seat support and/or the backrest support, may be provided for example for an intentional temporal supporting of a person sitting on the chair. The armrest supports can here also be connected to each other, for example a common joint may be guided below the seat support and in addition may be connected with it. The respective arm rest support may be provided for supporting an arm rest body or simply an arm rest padding. Alternatively, the armrest support can also directly form an arm rest body.

In accordance with a further embodiment the transmission has a first stop which limits a pivoting range of the seat support and the backrest support in the upright position in such a manner that when reaching the stop a bias of the storage member is applied which holds the backrest support and the seat support in the upright position at the stop. In particular, the backrest is upright in this position. In this manner, always a defined position of the backrest support is guaranteed, also when the chair is not occupied. A preferred location for the arrangement of the stop may be for example near the second articulated rotation point, if present, such that the stop is disposed near the seat support. In this manner, a link in contact with the support would not be exposed to excessive strong torques.

In another advantageous embodiment the transmission exhibits a second stop which limits the pivoting range of the seat support and the backrest support in a maximal pivoted position and/or the transmission may be provided with a locking element which fixes the seat support and the backrest support in a selectable pivoted position against at least one movement direction. Thus, on the one hand it can be avoided that the pivoting range backwardly exceeds a maximal pivoting angle of for example in the order of 20°, and on the other hand, the dynamics of the chair may be restricted as appropriate also for a selectable time interval. This restriction or fixation can also apply to both movement directions.

In accordance with a preferred embodiment the second articulated rotation point or a third virtual rotation point can be arranged in a backwards region and the second virtual rotation point can be arranged in a forward region of the seat support, wherein the second link exhibits a larger length and/or a larger inclination than the first link. In this manner, the seat support will be, when pivoting from the upright to the backward pivoted position, lifted more in the forward region than in the backward region such that the seat support will be pivoted slightly backwards.

In a further embodiment the length and/or the inclination of the first and second links are respectively provided in such a manner that the ratio of a pivoting angle of the backrest support to the pivoting angle of the seat support in the backwards pivoted position is 2 to 1 up to 4 to 1, in particular 3 to 1. For example, in this connection the backrest support is pivotable backwards to 21° whilst the seat support is pivotable backwards to 7°.

An independent height positioning of the seat position allows at the chair according to the invention for example a further embodiment in which a manipulatable height adjustment means is connected with the storage member which can be operated via a handle which is arranged and engageable in a region of the seat support. Thus, it is possible, also when the chair is occupied, to manipulate as necessary a height adjustment means, for example in the form of a gas spring.

In order to allow, in accordance with a further embodiment, a decoupled movement of the seating surface with respect to the seat support and thus to allow with respect to the backrest support differently low adjustable seating positions, a seating element may be arranged at the seat support which is fixable or provided fixed or is provided displaceable along the seat support by means of a guiding means. Such a guiding means may be a carriage arranged at the seat support (2) or a guiding rail.

In accordance with a further embodiment of a chair, in particular a swivel chair according to the invention, the seat support describes a single-piece bracket shape including an angle of at least 180°. Thus, there is provided a bracket-like body integrally formed in one piece which exhibits a certain flexibility which is suitable as force storage. Preferably, the bracket shape includes an angle of at least 210°, particularly preferred in a range from 210° to 240°. In this manner, the entire seat support acts as a kind of bracket spring which is tensioned, when pivoting the backrest support in the backwards pivoted position, and is in particular tensioned to the outside. In this manner a restoring force for pivoting back into the upright position is provided. The seat basis or the swivel chair basis, respectively, provides the supporting point or fixation point of the kinematics. Thus, in the region of the base receiving portion the seat support is not shifted during the pivoting action. Relatively thereto the seat support is shifted most in the region of the seat reception portion during pivoting. The portion of the seat support serving as force storage between the seat receiving portion and the base receiving portion compensates this shifting by an elastic deformation or bending.

In accordance with an embodiment the force storage has a spring arm connecting the seat receiving portion with the base receiving portion, wherein the spring arm forms at least a part of the bracket shape. The spring arm is in particular embodied more flexible than the base receiving portion. In addition, it can also be embodied more flexible than the seat receiving portion. Preferably it is, for providing the higher flexibility, configured thinner and/or with a lower geometrical moment of inertia. In this manner, the deformation can be influenced in such a manner that the deformations and tensions occur in the region of the spring arm such that the connections to the seat basis or the swivel chair base, respectively and to the seating surface thereof are not affected.

According to a further embodiment the backrest support has a link coupled with the first rotation point and the second rotation point, wherein the link is pivoted in the upright position relative to the gravitational direction and which is pivoted into a position approaching the gravitational direction when being pivoted backwards such that the seat receiving portion is lifted during the backwards pivoting. The link is for example embodied as one piece or is formed integrally with the backrest support. Advantageously, no additional links are consequently necessary for the transmission. In this manner, on the one hand the part count is decreased and on the other hand a very slender exterior appearance is possible. In particular, the only connection elements which are visible are the two rotation points, which is particularly advantageous concerning design aspects.

In accordance with an embodiment the link is embodied for a self-regulating adaptation of the restoring force to a weight imposed on the seating surface. The seating surface is here received or coupled with the seat receiving portion. In particular, a lever length and and/or a setting angle in the upright and in the backwardly pivoted position is respectively embodied such that the spring force predetermined by the formation of the seat support is supplemented by a moment/torque caused by the weighting force and providing an additional restoring force.

The above embodiments and configurations can be, as much as useful, combined with each other arbitrarily. In particular, all features of the chair according to the invention are transferable to a swivel chair in accordance with the invention and vice versa.

Further possible embodiments, improvements and implementations of the invention also comprise not explicitly stated combinations of the features of the invention described before or in the following embodiments. In particular, the skilled person will also add single aspects as improvements or supplements to the respective basic construction of the present invention.

BRIEF DESCRIPTION OF THE DRAWINGS

The present invention will be explained with more detail hereinafter with reference to the embodiments stated in the schematic figures of the drawing. In the drawings.

Figure 1:
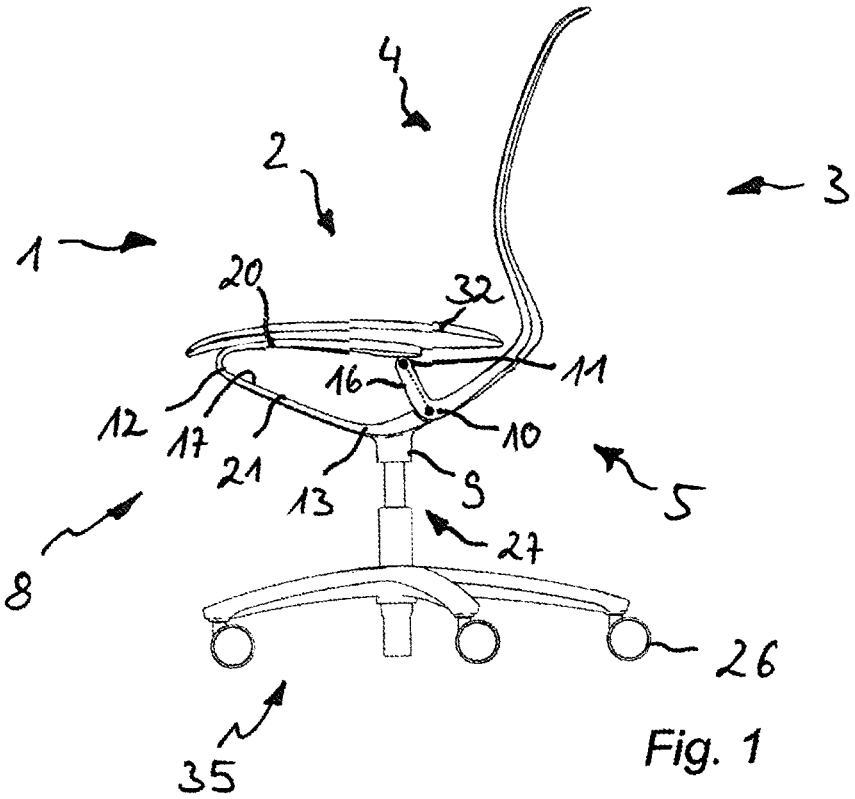
FIG. 1 is a planar side view of a first embodiment of a chair in an upright position including a transmission with two articulated rotation points.

The attached figures of the drawing shall convey a further understanding of the embodiments of the invention. They illustrate embodiments and in connection with the description serve the explanation of the principles and concepts of the invention. Other embodiments and many of the stated advantages are apparent in view of the drawings. The elements of the drawings are not necessarily shown true to scale with regard to each other.

In the figures of the drawing the same, functionally same or equally acting elements, features and components are, unless otherwise stated, respectively provided with the same reference numerals.

DESCRIPTION OF THE EMBODIMENTS

Figure 2:
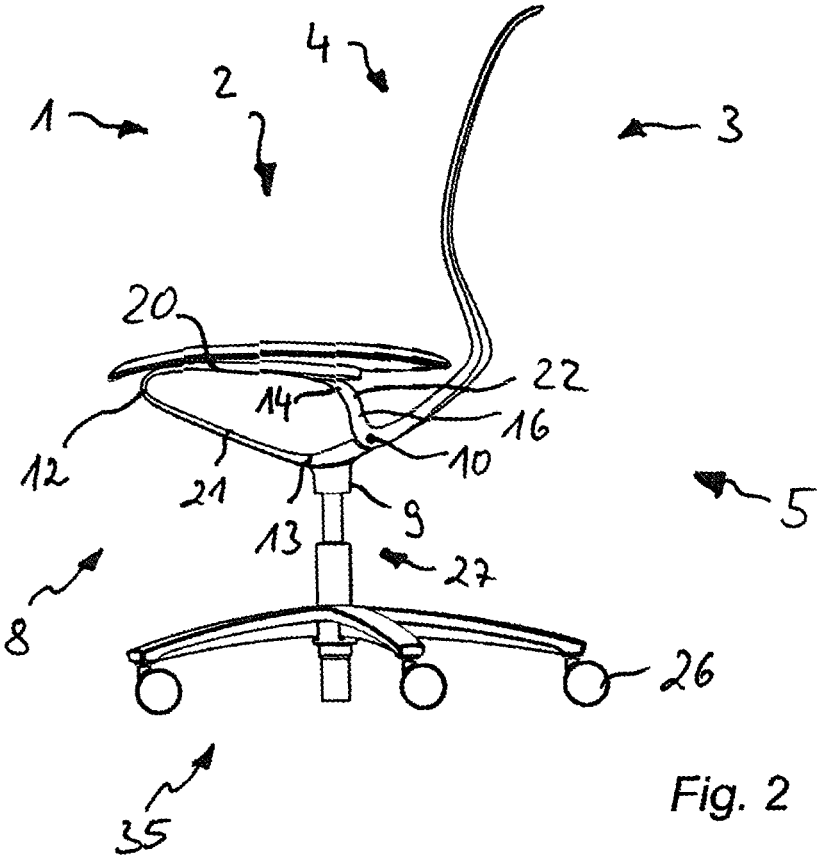
FIG. 2 a planar side view of a second embodiment of a chair in an upright position including a transmission with only one articulated rotation point.
Figure 3:
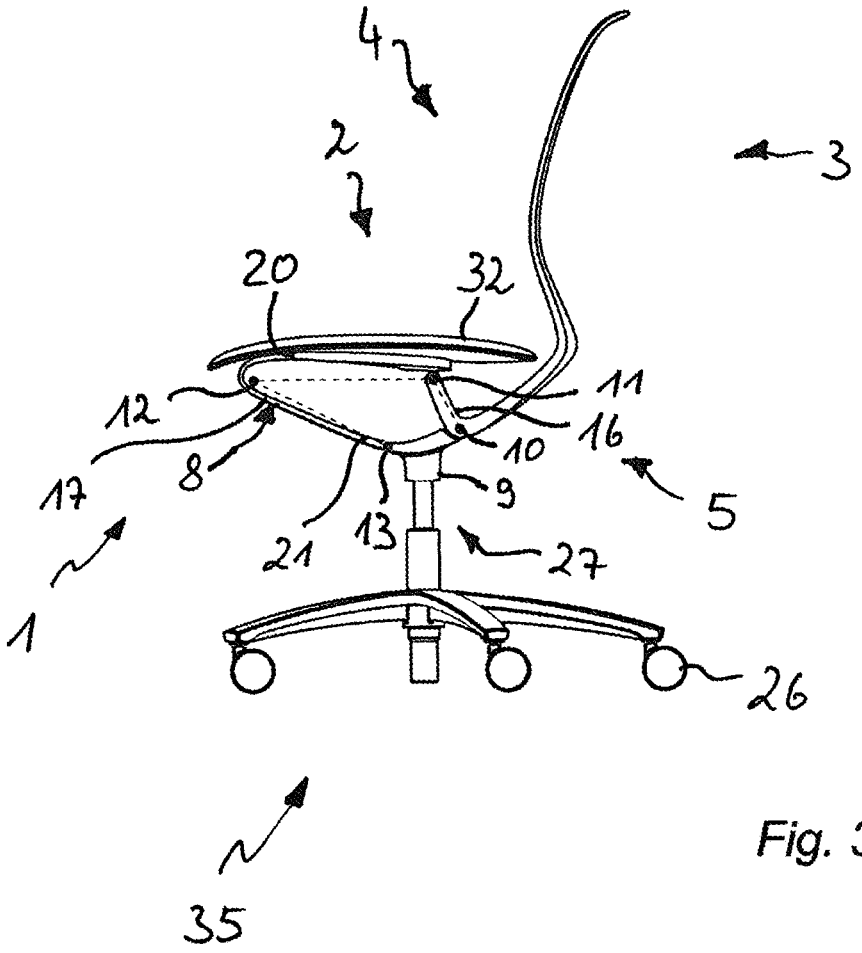
FIG. 3 a planar side view of the chair of FIG. 1 including virtual rotation points which are additionally recognizable at the transmission.

Referring first to FIG. 1 to FIG. 3, these figures show a chair generally denoted with 1 which is as an example embodied as office swivel chair including a pedestal 35 with wheels 26.

In each of the plane side views of FIG. 1 to FIG. 3 a chair 1 is recognizable at which at a seat base 9 a supporting means 4 of the chair 1 is arranged. The supporting means 4 of the chair is provided with a seat support 2 and a backrest support 3 as well as with a transmission 5 coupling the seat support 2 with the backrest support 3.

The transmission 5 enables a pivoting of the backrest support 3 and the seat support 2 between an upright and a backwardly pivoted position in a predetermined sequence of movements.

At the transmission 5 there is provided and installed a flexibly elastic storage element 8 which when charging the supporting means provides a restoring force into the upright position. Furthermore, the flexibly elastic storage member 8 forms a kinematic chain 15 in conjunction with at least a first articulated rotation point 10.

The aforementioned kinematic chain 15 is a feature of the system built by the transmission 5 which presents a gear and is configured for the transfer of movements and torques. This is most easily recognizable from FIG. 3 which illustrates the chair of FIG. 1 with its first articulated rotation point 10 as well as its second articulated rotation point 11 and furthermore also the further virtual rotation points 12, 13 which are provided in the structure of the storage member 8 and around which the flexibly elastic storage element is capable to carry out rotational movements due to its shape in conjunction with its material properties.

Furthermore, it is also illustrated for the chairs 1 of FIG. 1 and FIG. 3 that the first articulated rotation point 10 of the transmission 5 is coupled with the seat base 9 and is fixedly arranged in relation thereto. The transmission 5 has a first virtual and a second virtual rotation point 12, 13 which are comprised by the storage member 8, and the first articulated rotation point 10 is coupled to the second articulated rotation point 11 arranged at the storage member 8 via a first link 16 which is illustrated with the dashed line connection of the two articulated rotation points 10, 11 in FIG. 1 and FIG. 3.

In this connection a virtual rotation point means a structural portion which by means of its elastic bending property allows a certain pivoting of two adjoining structural portions.

Also, the two virtual rotation points, 12, 13 are coupled to each other, via a second link 17, which is additionally illustrated in FIG. 3 with the dashed line. The dashed line connection of the second articulated rotation point 11 to the first virtual rotation point 12 only serves illustration of their coupling to the kinematic chain 15. The aforementioned first link 16 is connected fixedly with the backrest support 3 and in FIG. 1 and FIG. 3 it is for example formed integrally with the backrest support 3.

On the other hand, FIG. 2 illustrates a chair 1 according to the invention where in contrast to the illustrations of FIG. 1 and FIG. 3 the second articulated rotation point 11 is replaced by a third virtual rotation point 14 at approximately the same location on the storage member 8 or the seat support 2 which is, as described above for the other virtual rotation points 12, 13, integrated into the structure of the storage member 8 such that the kinematic chain 15 a is maintained. Thus, in this embodiment there are provided at the flexibly elastic storage member 8 three virtual rotation points 12, 13 and 14, configured according to the specifications of the shape and the material properties, and only one "real" articulated rotation point 10.

The mapping into virtual rotation points 12, 13, 14 of the storage member 8 of the transmission 5 at the chair 1 of FIG. 2 is here attributed for example to a fiber reinforced plastic material, similarly as before in FIG. 1 and FIG. 3 to the configuration of the storage member 8 in an elastically deformable material. This plastic material may be formed by polyamide.

Referring now to FIG. 4 to FIG. 7, FIG. 4 first of all shows a partially assembled chair 1 according to the invention the seat base 9 of which supports the supporting means 4 of the chair 1 versus the pedestal 35 including wheels 26 configured as rotating pedestal and which for this purpose is coupled with a height-adjustable pressure spring portion.

Figure 4:
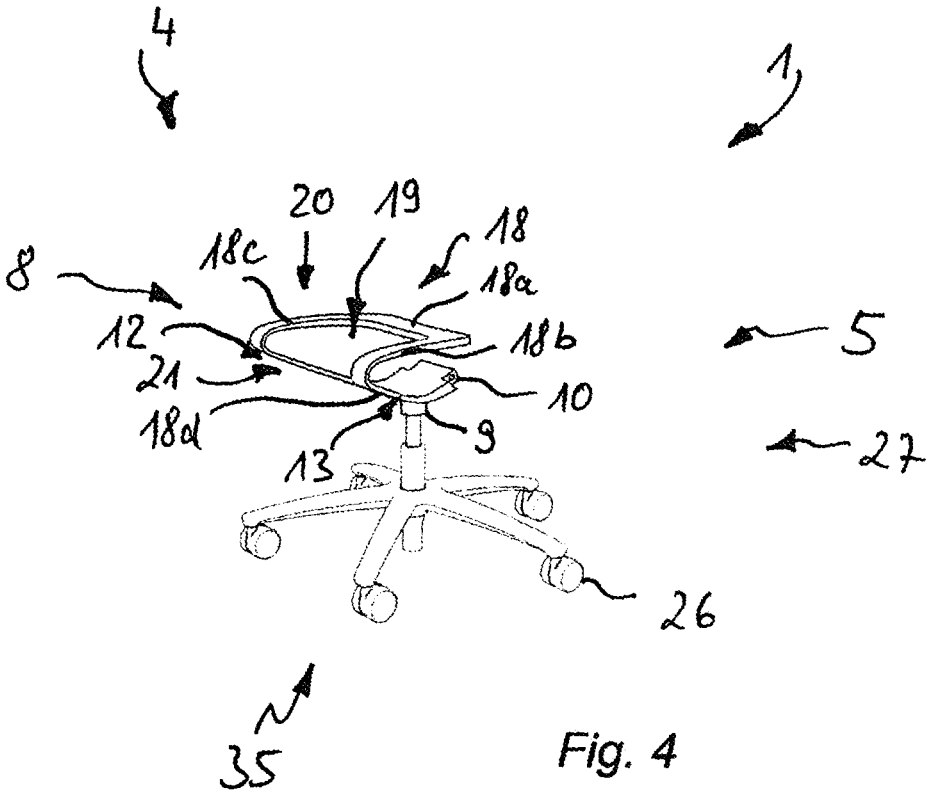
FIG. 4 a perspective side view of the chair with its seat base and a storage member at which a seat support is arranged.

In FIG. 4 the chair 1 is partially assembled insofar as only the storage member 8 which is fixedly connected with the seat base 9 and provides the transmission 5 is shown at the supporting means 4. In the perspective view of FIG. 4 it is illustrated that the storage member 8 includes a kind of bent frame 18 the frame portions 18*a*-18*d* of which surround a recess 19. In an assumed planar projection from the side, similarly as the illustrations in FIG. 7, the two frame portions 18*b*, 18*c* associated with the chair sides respectively form a curved frame side with an upper and a lower leg 20, 21 of which the lower legs 21 will form the second link 16 of the kinematic chain 15 to be established at the chair. Here, the storage member 8 which has a bent shape in the aforementioned projection forms an approximately acute angle in the order of 25° with the two legs 20, 21 in the idle position of the chair 1.

Figure 5:
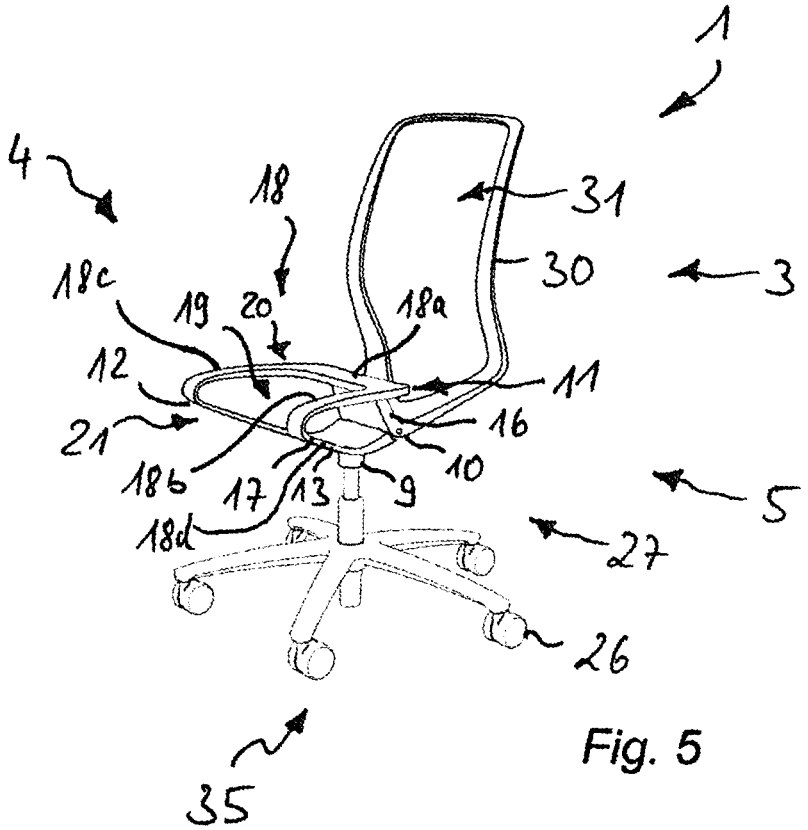
FIG. 5 a perspective side view of the chair of FIG. 4, at which a backrest support is connected with the storage member.

By imposing a bias on the storage member 8, the storage member 8 is in FIG. 5 coupled with the backrest support 3 at two articulated rotation points 10, 11 which are connected by the first link 16 as part of the backrest support 3. Furthermore, in FIG. 6 the chair 1 is provided with a seat support 2 such that the seat support 2 and the backrest support 3 are coupled by the transmission 5 of the support member 8. Furthermore, it is shown that the backrest support 3 is rotatably supported at the at least one articulated rotation point 10 in relation to the seat base 9 and that the storage member 8 or the seat support 2 connected thereto is provided in an end portion of its upper leg 20 with a second articulated rotation point 11 at which it is rotatably connected with the backrest support 3.

Figure 6:
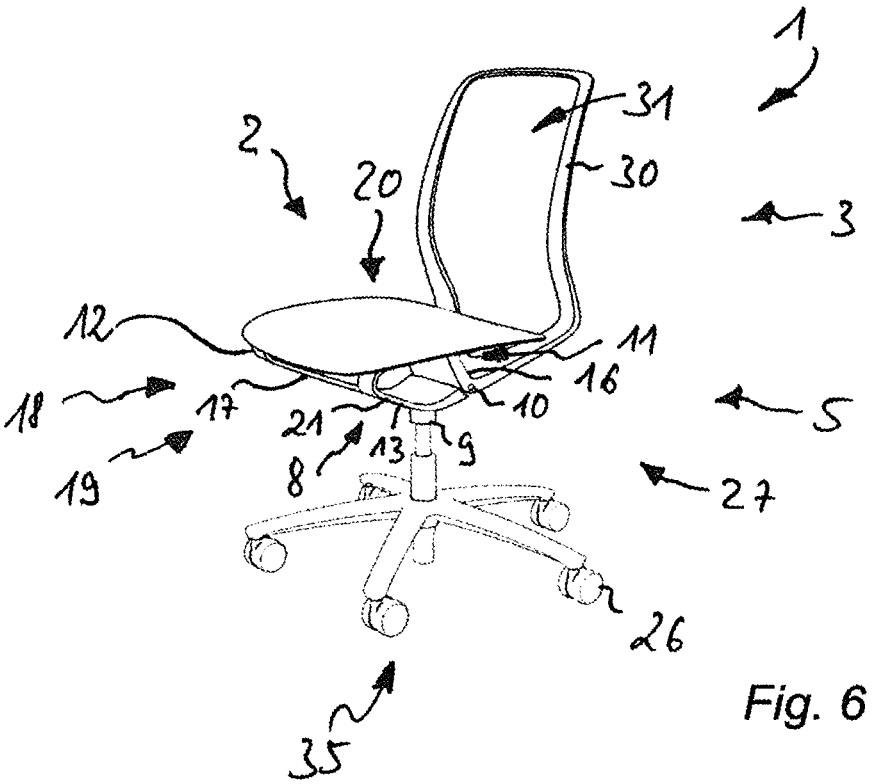
FIG. 6 a perspective side view of the chair of FIG. 5, at which a seat support is connected with the storage member.
Figure 7:
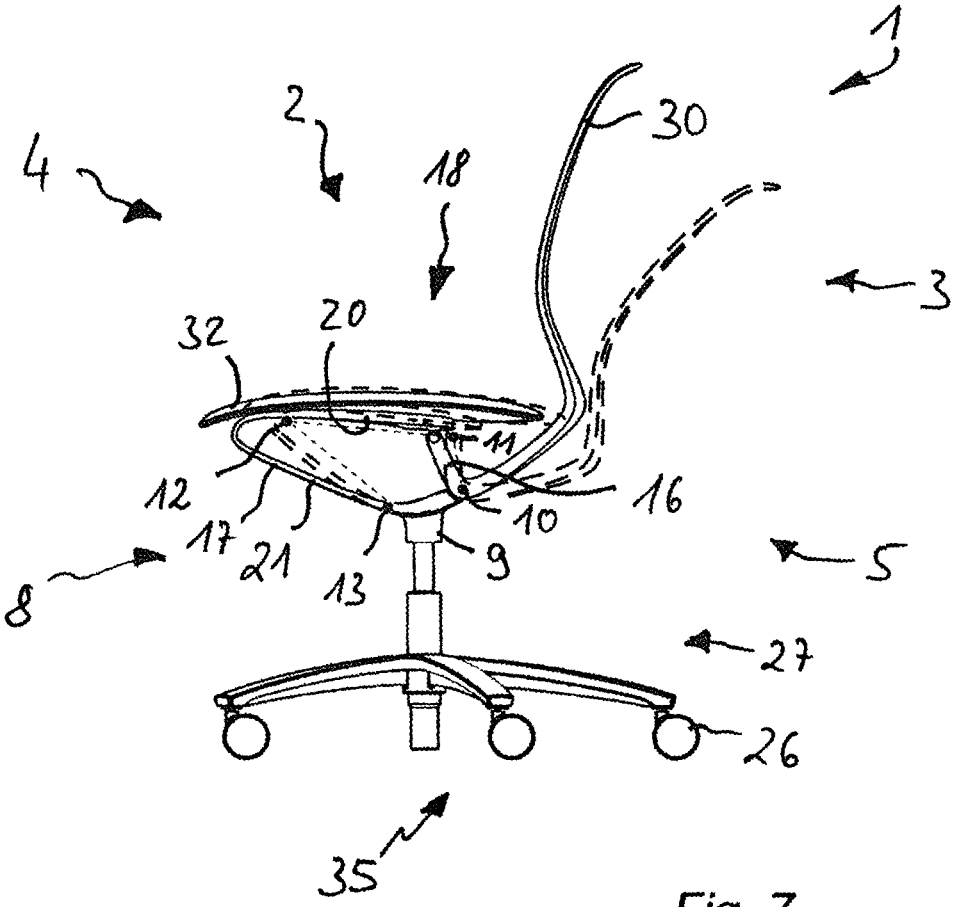
FIG. 7 a planar side view of the chair of FIG. 3, with the supporting means once in the idle position and once in the pivoted position (dashed lines)

In the embodiment of FIG. 2 the coupling of the end portion of the upper legs 20 of the storage member 8 is not realized as in FIG. 5 to FIG. 7 via a second articulated rotation point 11 but via a further virtual rotation point 4 such that the storage member 8 or the seat support 2 arranged thereto is rotatably fixedly connected with the backrest support 3 via a bar 22. FIG. 2 further illustrates that the aforementioned bar 22 then forms the first link 16 such that, in contrast to the embodiments with two articulated rotation points 10, 11, it is not "directly" part of the backrest support. However, since clearly in the embodiment of FIG. 2 the storage member 8 is integrally formed with the backrest support 3, the first link 16 is at least in this sense formed as part of the backrest support 3. The upper leg 20 of the storage member 8 is with its free end which forms the bar 22 or the link 16, when the bias is imposed, connected with the articulated rotation point 10 arranged in the region of the seat base 9.

Furthermore, FIG. 5 and FIG. 6 also illustrate that the backrest support 3 is essentially constituted by a backrest frame 30 which in turn surrounds a recess 31 and which can hold for example a not further illustrated padding or also a textile supporting braid.

FIG. 6 shows that here the flexibly elastic storage member 8 is connected to the seat support 2 which in turn is provided with a seat padding 32 shown in FIG. 7 as a seating element. Not shown is here the displaceable guide of the seating element.

The transmission 5 of the storage member 8 determines the sequence of movements of the supporting means with the seat support 2 and the backrest support 3 when pivoting from the upright position into a backwardly pivoted position as are shown in unison in FIG. 7 in which the latter position is illustrated with dashed lines. To this end the storage member 8 is as shown embodied and arranged such that it allows the sequence of movements of the seat support 2 and the backrest support 3 predetermined by the transmission 5. Furthermore, the storage member 8 provides the restoring force into the upright position, by means of the entire sequence of movements, and furthermore this force is also imposed in the upright position as a result of the coupling with bias.

Referring again to all figures and in particular to FIG. 3 and FIG. 7, it is clear that when charging the respective chair 1, for example by a person who is in the process to sit down, the backrest support 3 is pivoted backwards to a pivoting angle, as is particularly shown in FIG. 7. The first link 16 extending between the first and the second articulated rotation point 10, 11 is, in conjunction with the backrest support 3, pivoted to the same angle. Due to the inclination of the first link 16 and the seat support 2 and thus of the storage member 8, also the second link 17 is pivoted.

Both links 16 and 17 are inclined forwardly in the upright position as well as in the backwardly pivoted position such that a gravitational force of a person sitting on the chair 1 causes a restoring torque and such that storage member formed as a force storage element only needs to work against the backrest force. The backwardly pivoted position is achieved by the person sitting on the chair 1 leaning backwards and thus exerting on the backrest support 3 a back leaning force which exceeds a spring force of the storage member 8.

The entire seating surface formed by the seat support provided with a seating padding is lifted slightly and additionally also pivoted, though compared to the backrest support 3 to a much lesser degree. The storage member 8, as best apparent from FIG. 7, is in its tensioned state charged according to both pressure and bending and is hence elastically compressed and bent. The backwardly pivoted position of the supporting means 4 is reached when a person sitting on the chair leans backwards and thus exerts a backwards leaning force on the backrest support 3 which exceeds a spring force of the storage member 8.

Notwithstanding the large pivoting region possible with the configurations of the figures, all visible components of the chair 1, in particular the backrest support 3, the first link 13, the seat base 9 and the second link 14 as well as the seat support 2, are configured very slender. The same applies for the storage member 8.

Furthermore, no additional components are arranged between the seat support 2 and the seat base 9 and between the seat support 2 and the backrest support 3, respectively. In this manner in total a greatly slender design is created without jeopardizing functionality compared to a conventional synchronizing mechanism.

Not shown in the figures of the drawing is a first stop restricting the pivoting region of the seat support 2 and the backrest support 3 in the upright position as well as a second stop restricting a pivoting region of the seat support 2 and the backrest support 3 in the pivoted position. These stops are provided in the region of the first or if provided of the second articulated rotation points 10, 11 in the form of stop wedges which are supported at respectfully suitable points in the upright position and in the pivoted position.

The stops are arranged and configured such that when reaching the first stop still a bias of the storage member 8 holding the backrest support 3 and the seat support 2 in the upright position is exerted. In this manner, a defined setting of the transmission 5, the seat support 2 and the backrest support 3 is guaranteed also in the upright position.

Figure 8A:
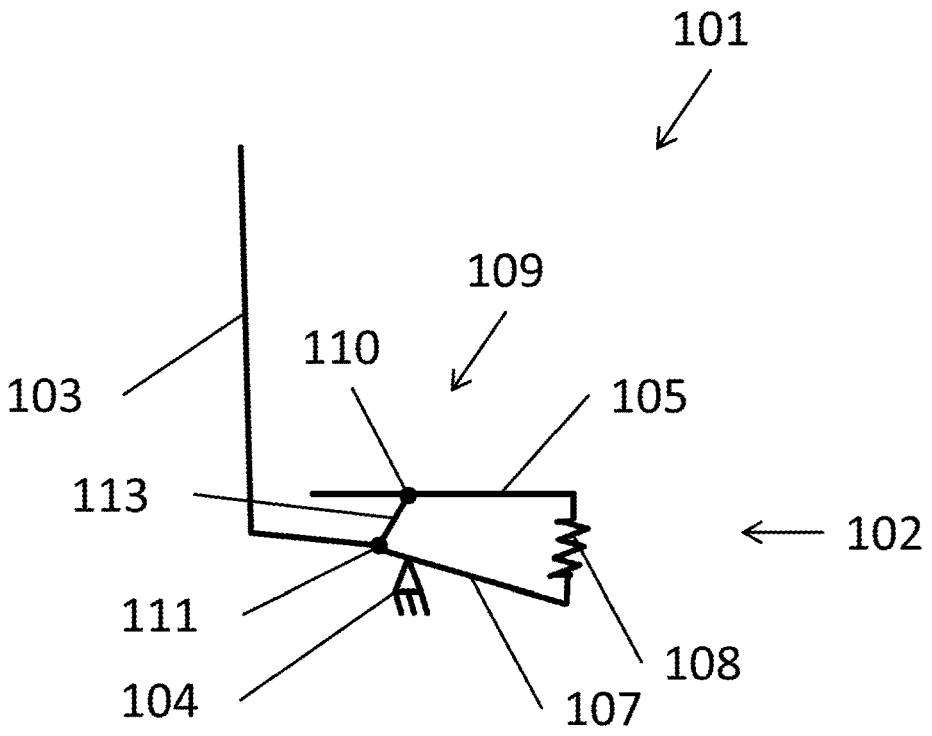
FIG. 8A a schematic drawing of the kinematics of a chair in an upright position.

FIG. 8A shows a schematic drawing of the kinematics of a chair 101 in an upright position.

A swivel chair base 104 of the chair is here illustrated schematically as fixed bearing. In the case of a swivel chair the seat base can of course also include a degree of freedom around the vertical axis.

The seat base is coupled to a seat support 102. The seat support 102 includes a seat receiving portion 105 for receiving a seating surface, a base receiving portion 107 for receiving the swivel chair base 104 and a force storage 108 formed integrally with the seat receiving portion 105 and the base receiving portion 107. The seat support is here in particular formed in one piece. The portions, therefore, thus only form functional portions which are, however, formed integrally to each other.

The chair 101 further includes a backrest support 103 which is coupled to the seat support 102 at two locations. To this end a transmission 109 coupling the seat support 102 to the backrest support 103 is provided wherein the transmission 109 allows a pivoting of the backrest support 103 and the seat receiving portion 105 with a predetermined sequence of movements between an upright position and a backwardly pivoted position. The transmission 109 includes a first rotation point 110 which couples the backrest support 103 to the base receiving portion 107 of the seat support 102 rotatably. Furthermore, a second rotation point 111 of the transmission 109 is provided which couples the backrest support 103 to the seat receiving portion 105 rotatably.

The force storage 18 of the seat support 102 provides a predetermined elastic deformation. A pivoting of the backrest support 103 thus causes an elastic deformation of the seat support in the region of the force storage 108. Due to the integral formation of the force storage 108 with the base receiving portion 107 and the seat receiving portion 105 a certain relative movement of the seat receiving portion 105 relative to the base receiving portion 107 is thus provided. A predetermined sequence of movements associated with this relative movement is predetermined by the configuration of the force storage 108.

In the illustrated upright position the force storage 108 is essentially released. A pivoting of the backrest support 103 and by means of the kinematic coupling via the transmission 108 also of the seat receiving portion 105 causes an elastic deformation of the force storage 108. In this manner the force storage 108 provides a force restoring the backrest support 13 and the seat receiving portion 105 into the upright position when it is shifted into a backwardly pivoted position.

Figure 8B:
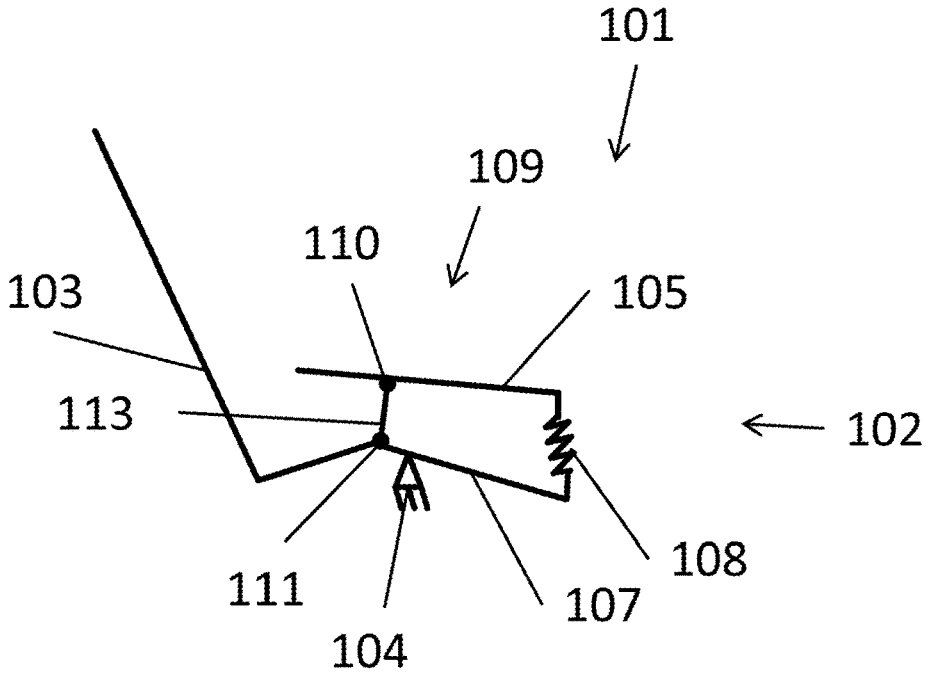
FIG. 8B a schematic of the kinematics in accordance with FIG. 8A in a backward pivoted position.

FIG. 8B shows a schematic drawing of the kinematics according to FIG. 8A into a backwardly pivoted position.

Here, the force storage 108 is illustrated as correspondingly elastically deformed. While the base receiving portion 107 of the seat support maintains its original position, the seat coupling portion 105 is relative thereto shifted by means of the transmission 109. To this end the transmission 109 includes a link 113 mounted at the backrest 303 or formed integrally therewith.

In the upright position according to FIG. 8A the link 113 is, relative to the gravitational direction here extending vertically, pivoted forwardly. When pivoting the backrest support 103 backwardly, the link 113 is hence pivoted into a position which approximates the gravitational direction. In this manner the seat receiving portion 105, when pivoting backwards, on the one hand is lifted and on the other hand is displaced backwardly.

In the completely backwardly pivoted position of the backrest support 103 illustrated in FIG. 8B there is still provided a minor remaining forward angulation of the link 113. In this manner a weight charged on the seat receiving portion 105 by a person sitting on a seating surface mounted thereon acts in an restoring manner additionally to the bias of the force storage 108. In this manner, a restoring force is advantageously always automatically adapted to the weight of a person sitting on the chair. The link 113 thus serves a self-regulating adaptation of the restoring force to a weight charged on the seating surface which is supported with the seat receiving portion 105.

Accordingly the chair remains in the backwardly pivoted position if a person sitting on the chair displaces his/her weight on a backrest coupled to the backrest support 103. However, if the backrest is released, the backrest support 103 automatically straightens up by means of the restoring force stored in the force storage 108 and by means of the restoring force caused by the angulation of the link 113 with the intrinsic weight of the person.

Figure 9:
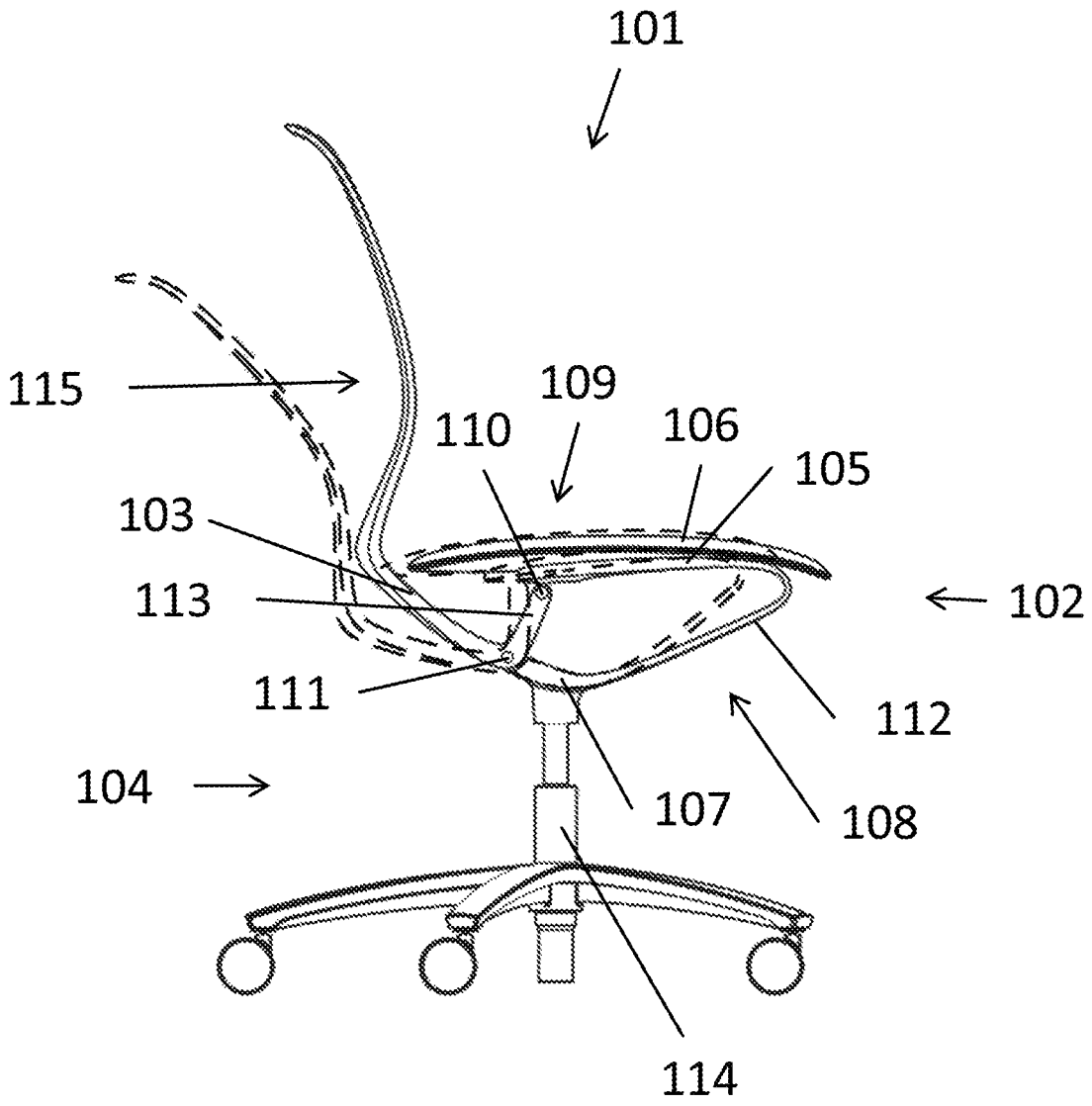
FIG. 9 a side view of a chair with a kinematics in accordance with FIG. 8A and FIG. 8B.

FIG. 9 shows a side view of a swivel chair including a kinematics according to FIG. 8A and FIG. 8B.

The swivel chair 101 illustrated here is an office swivel chair with a rotating pedestal 114 provided with wheels. However, of course other configurations without such wheels are envisaged, for example for a conference swivel chair.

The solid lines here illustrate an upright position and the dashed lines illustrate a backwards pivoted position.

The backrest support 103 acts in this configuration simultaneously as backrest frame and is thus integrally formed with the backrest 115. Furthermore, the link 113 is formed integrally as one piece with the backrest support 103. To this end the backrest support 103 is angled in the region of the second articulated point 11.

Furthermore, the seat support 102 describes, starting from the second rotation point 111, a single-piece bracket shape extending to the first rotation point 110. From the second rotation point 111 to the first rotation point 110 the bracket shape here forms an angle of roughly 210° in the upright position. This angle is of course adaptable to the geometry and the design of the seat support and is in a range >180°, preferably in a range between 200° to 240°. In this manner, the seat support, with an appropriate material selection, can be tensioned or extended like a spring and can thus be employed as force memory.

The bracket shape can advantageously be divided into different functional portions. The legs of the bracket shape serve here as the base receiving portion and the seat receiving portion. They are accordingly formed relatively rigid. In between there is provided a bar connecting the two legs wherein the bar is configured as spring arm 112 and is formed accordingly elastically deformable. The spring arm 112 is angled with respect to the base receiving portion 107 and the seat receiving portion 105 and forms a part of the bracket shape therewith.

A seating surface 106 is mounted on the seat receiving portion 105 wherein the seating surface 106 includes a structural part or a seating shell introducing the seating forces into the seat support, and a seating padding. In further embodiments also a configuration without padding of a seating shell is possible.

Although the present invention has been completely described with reference to preferred embodiments, the invention is not limited thereto but can be modified in various kinds and manners.

LIST OF REFERENCE NUMERALS

1 chair
2 seat support
3 backrest support
4 supporting means
5 transmission
8 storage member
9 seat base
10 first articulated rotation point
11 second articulated rotation point
12 further or first virtual rotation point
13 further or second virtual rotation point
14 further or third virtual rotation point
15 kinematic chain
16 first link
17 second link
18 frame part
18A-18D frame portions
19 recess
20 upper leg
21 lower leg
22 bar
25 locking element
26 wheel
27 height adjustment means
30 backrest frame
31 groove
32 seat padding
35 pedestal
101 swivel chair
102 seat support
103 backrest support
104 swivel chair base
105 seat receiving portion
106 seating surface
107 base receiving portion
108 force storage
109 transmission
110 first rotation point
111 second rotation point
112 spring arm
113 link
114 rotating pedestal
115 backrest

The invention claimed is:

1. A chair, including a seat base, at which a supporting means of the chair is disposed, wherein:

the supporting means has at least one seat support and at least one backrest support;

the supporting means is provided with a transmission coupling the seat support to the backrest support which allows for pivoting the backrest support and the seat support between an upright position and a backwardly pivoted position using a predetermined sequence of movements, a flexibly elastic storage member is provided and installed at the transmission which, when the supporting means is charged, provides a force restoring to the upright position, and the flexibly elastic storage member in conjunction with at least one first articulated rotation point of the transmission forms a kinematic chain wherein the flexibly elastic storage member is one of (a) connected with the seat support, (b) formed on the seat support or (c) formed in one piece with the seat support.

2. The chair according to claim 1, wherein the transmission includes the first and a second articulated rotation point.

3. The chair according to claim 1, wherein the flexibly elastic storage member comprises at least two further rotation points of the kinematic chain or the storage member comprises at least two virtual rotation points.

4. The chair according to claim 3, wherein the at least one articulated rotation point of the transmission is coupled with the seat base and is fixedly arranged relative thereto and wherein the transmission has a first virtual and a second virtual rotation point which are comprised by the storage member, wherein the at least one articulated rotation point is coupled via a first link with a second articulated rotation point arranged at the storage member and the two virtual rotation points are coupled to each other via a second link, wherein the first link is fixedly connected with the backrest support or is integrally formed with the backrest support.

5. The chair according to claim 3, wherein the backrest support is rotatably supported at the at least one articulated rotation point with regard to the seat base and the storage member or the seat support connected thereto is provided at a free end with the second articulated rotation point, at which it is rotatably connected with the backrest support.

6. The chair according to claim 3, when the at least one articulated rotation point of the transmission is coupled with the seat base and is fixedly arranged thereto and wherein the transmission has a first virtual and a second virtual rotation point which are comprised by the storage member, wherein the at least one articulated rotation point is connected to a third virtual rotation point arranged at the storage member via a first link and the first and second virtual rotation point are coupled together via a second link, wherein the first link is fixedly connected with the backrest support or is integrally formed with the backrest support.

7. The chair according to claim 6, wherein the backrest support is rotatably supported at the at least one articulated rotation point with respect to the seat base and the storage member or the seat support connected thereto is at a free end flexibly connected with the backrest support via a bar, and thus forms the third virtual rotation point.

8. The chair according to claim 1, wherein the storage member of the transmission is formed from an elastic deformable plastic material, in particular a fiber-reinforced plastic.

9. A chair, including a seat base, at which a supporting means of the chair is disposed, wherein:

the supporting means has at least one seat support and at least one backrest support;

the supporting means is provided with a transmission coupling the seat support to the backrest support which allows for pivoting the backrest support and the seat support between an upright position and a backwardly pivoted position using a predetermined sequence of movements, a flexibly elastic storage member is provided and installed at the transmission which, when the supporting means is charged, provides a force restoring the seat support to the upright position, and the flexibly elastic storage member in conjunction with at least one first articulated rotation point of the transmission forms a kinematic chain, wherein the storage member has a bent shape, which in the idle position of the chair forms an acute angle between 1° and 40°.

10. The chair according to claim 9, wherein the acute angle is between 10° and 30°.

11. The chair according to claim 1, wherein at the supporting means at least one arm rest support is arranged at a respective one of the at least one chair side, wherein each armrest support is connected with the seat support and/or the backrest support.

12. The chair according to claim 1, wherein the transmission has a first stop, which restricts a pivoting range of the seat support and the backrest support in the upright position such that when reaching the stop a bias of the storage member is applied holding the backrest support and the seat support in the upright position at the stop.

13. The chair according to claim 1, wherein the transmission has a second stop which restricts the pivoting range of the seat support and the backrest support in a maximally pivoted position and/or the transmission is provided with a locking element which fixes the seat support and the backrest support in a selectable pivoted position with regard to at least one movement direction.

14. The chair according to claim 4, wherein the length and/or the inclination of the first and second links are respectively provided such that a ratio of the pivoting angle of the backrest support to a pivoting angle of the seat support in the backwardly pivoted position is 2 to 1 to 4 to 1.

15. The chair according to claim 6, wherein the length and/or the inclination of the first and second links are respectively provided such that a ratio of the pivoting angle of the backrest support to a pivoting angle of the seat support in the backwardly pivoted position is 2 to 1 to 4 to 1.

16. The chair according to claim 1, wherein a manipulatable height adjustment means is provided and installed, which can be operated via a handle which is engageable and is arranged in the region of the seat support.

17. The chair according to claim 1, wherein a seat element is arranged at the seat support wherein the seat element is fixable or is fixed or is provided displaceable along the seat support by means of a guiding means.

18. A method for manufacturing a chair, comprising the steps of:

providing a supporting means having a seat support, a backrest support and a transmission coupling the seat support to the backrest support which allows for pivoting the backrest support and the seat support between an upright position and a backwardly pivoted position using a predetermined sequence of movements;

coupling a storage member provided and installed at the transmission to the supporting means so that the predetermined sequence of movement is facilitated and a force restoring to the upright position is provided by the storage member, wherein a kinematic chain is formed by the flexibly elastic storage member with at least one first articulated rotation point of the transmission, wherein the flexibly elastic storage member is one of (a) connected with the seat support, (b) formed on the seat support or (c) formed in one piece with the seat support.

19. The method according to claim 18, wherein the storage element has at least in a planar projection a bent shape with two legs which are connected at respectively one articulated rotation point with the backrest support.

20. A method for manufacturing a chair, comprising the steps of:

providing a supporting means having a seat support, a backrest support and a transmission coupling the seat support to the backrest support which allows for pivoting the backrest support and the seat support between an upright position and a backwardly pivoted position using a predetermined sequence of movements;

coupling a storage member provided and installed at the transmission to the supporting means so that the predetermined sequence of movement is facilitated and a force restoring to the upright position is provided by the storage member, wherein a kinematic chain is formed by the flexibly elastic storage member with at least one first articulated rotation point of the transmission, wherein the storage member has a bent shape, which in the idle position of the chair forms an acute angle between 1° and 40°.

* * * * *